US007254841B1

(12) United States Patent
Nelson et al.

(10) Patent No.: US 7,254,841 B1
(45) Date of Patent: Aug. 14, 2007

(54) VEST SERVING AS PORTABLE LOCKOUT STATION FOR MACHINE MAINTENANCE

(75) Inventors: Steven Curtis Nelson, N5802 Hwy. HH, Mauston, WI (US) 53948; Todd Timothy Johnson, Reedsburg, WI (US)

(73) Assignee: Steven Curtis Nelson, Mauston, WI (US)

( * ) Notice: Subject to any disclaimer, the term of this patent is extended or adjusted under 35 U.S.C. 154(b) by 561 days.

(21) Appl. No.: 10/890,534

(22) Filed: Jul. 13, 2004

(51) Int. Cl.
*A41D 1/04* (2006.01)

(52) U.S. Cl. ..... 2/102; 2/94; 2/51

(58) Field of Classification Search ..... 2/94, 2/102, 51, 48, 46, 79, 115, 247, 249–254, 2/108, 85, 93; 206/580, 38.1, 37.1, 37.3, 206/37.4, 37.6; 224/935, 623, 223, 600–602, 224/230, 660; 70/1, 14, 431
See application file for complete search history.

(56) References Cited

U.S. PATENT DOCUMENTS

| | | | | |
|---|---|---|---|---|
| 3,266,070 | A * | 8/1966 | O'Link | 441/112 |
| 4,328,533 | A | 5/1982 | Paredes | |
| D280,860 | S | 10/1985 | Monferrato | |
| 4,637,075 | A * | 1/1987 | Ingrisano et al. | 2/94 |
| 4,669,127 | A * | 6/1987 | Swanson | 2/46 |
| 5,014,359 | A * | 5/1991 | Hanson | 2/94 |
| 5,070,436 | A | 12/1991 | Alexander et al. | |
| 5,072,456 | A * | 12/1991 | Elin | 2/94 |
| 5,211,321 | A * | 5/1993 | Rodriguez | 224/604 |
| 5,247,707 | A * | 9/1993 | Parker et al. | 2/102 |
| 5,265,782 | A * | 11/1993 | McNamara | 2/94 |
| D382,670 | S | 8/1997 | Sayre | |
| 5,940,883 | A * | 8/1999 | Daoust | 2/102 |
| 6,267,482 | B1 | 7/2001 | Miller et al. | |
| 7,032,250 | B1 * | 4/2006 | Davis et al. | 2/102 |
| 2001/0052532 | A1 * | 12/2001 | Perez et al. | 224/575 |
| 2002/0152533 | A1 * | 10/2002 | Lesley | 2/102 |
| 2006/0248627 | A1 * | 11/2006 | Austin et al. | 2/102 |

* cited by examiner

*Primary Examiner*—Amy B. Vanatta
(74) *Attorney, Agent, or Firm*—Craig A. Fieschko, Esq.; DeWitt Ross & Stevens S.C.

(57) ABSTRACT

A vest is configured to serve as a portable lockout station, whereby maintenance workers may conveniently carry safety lockout padlocks (and their keys) and safety lockout tags from one maintenance location to another to allow them to impose a safety lockout on machinery when working on the machinery. The vest is preferably brightly colored and provided with reflective stripes so that it is readily visible to others around the maintenance location, and it includes pockets which are specially configured to complementarily fit safety lockout padlocks and tags for easy storage and access. The pockets are also formed of material which is at least partially transparent, such as mesh, and are placed on a location on the vest which is readily visible to the wearer such that the wearer can readily note when a safety lockout padlock is absent (e.g., when one has been forgotten at a prior maintenance location). The wearer of the vest is thereby encouraged to follow proper lockout procedures because lockout equipment is readily at hand, is maintained in an organized state, and is not easily forgotten when leaving one maintenance location to work at another location.

21 Claims, 1 Drawing Sheet

THE FIGURE
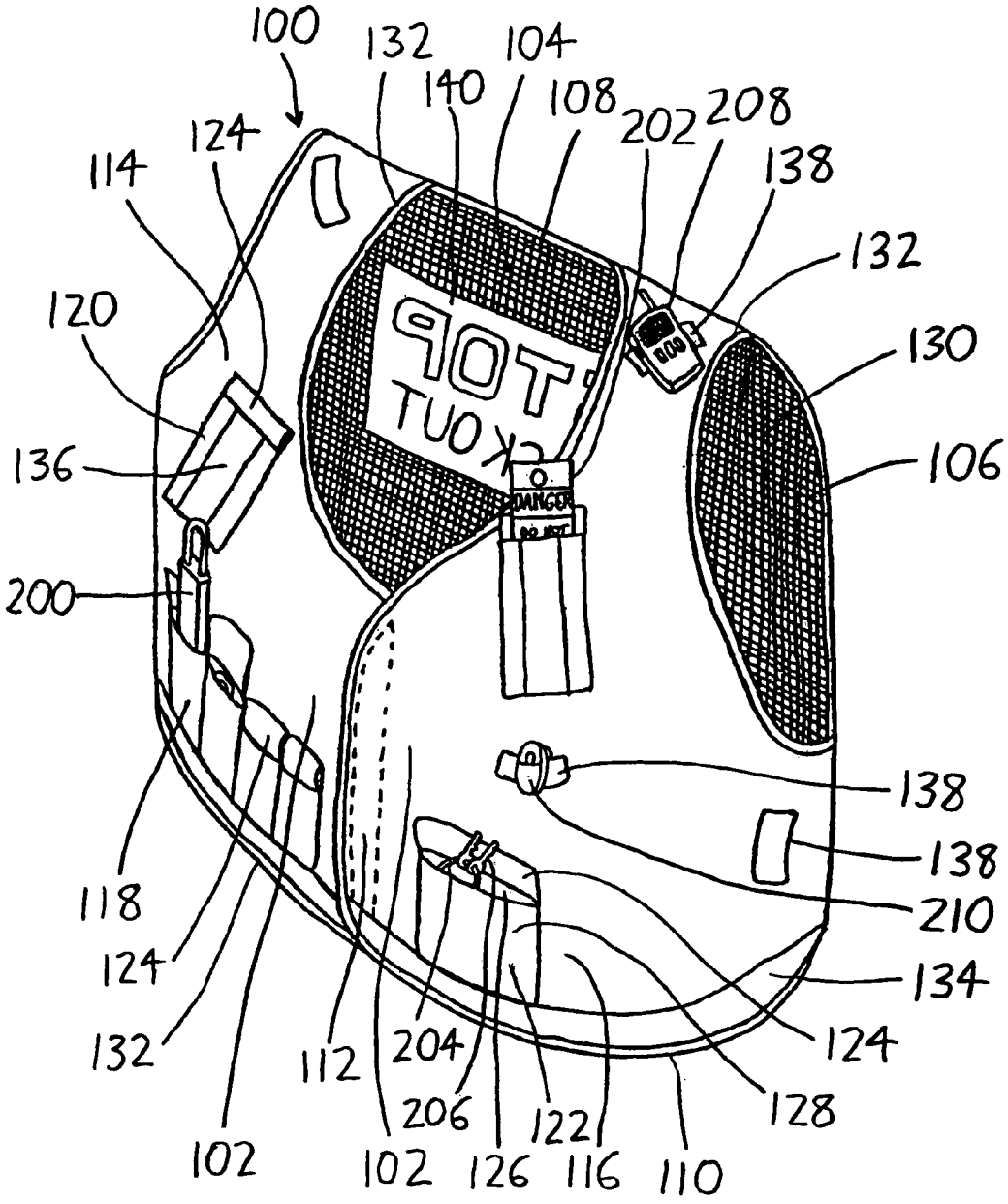

VEST SERVING AS PORTABLE LOCKOUT STATION FOR MACHINE MAINTENANCE

FIELD OF THE INVENTION

This document concerns an invention relating generally to industrial safety, and more specifically to protective wear for industrial maintenance and repair.

BACKGROUND OF THE INVENTION

Many industrial fields utilize machinery such as presses, lifts, and furnaces which can be potentially hazardous to personnel if maintenance of the machines is initiated while the machines are still powered, or if the machines still include residual energy from prior operation. Thus, OSHA (the Occupational Safety and Health Administration) has mandated certain procedures, known as "lockout" or "tagout" procedures, that workers must use when engaging in machinery maintenance or setup. As of the year 2004, the lockout procedures dictated in Title 29, Section 1910.147 of the Code of Federal Regulations (29 CFR §1910.147) state that each worker must learn how to disengage the power source of (and to "power down" any residual energy in) each item of machinery on which the worker may operate. Such machines are often provided with "lockouts," areas on the machines where moving parts may be fixed together, control panels may be secured, or power sources may be isolated, by use of one or more safety lockout padlocks (sturdy padlocks which usually have an elongated hasp and a brightly-colored body). Thus, once the machinery power source is disengaged and the residual energy is dispersed, the worker uses the safety lockout padlock(s) to "lock out" any item of machinery on which maintenance is to be performed, thereby preventing the machine from operating or otherwise releasing energy (and preventing harm to the maintenance worker operating on the machine).

Often, each worker is assigned a set of safety lockout padlocks which can only be opened with a single key which is uniquely assigned to that worker. Thus, only the worker assigned those safety lockout padlocks (and their key) may open the safety lockout padlocks once an item of machinery is locked down. The worker is also assigned safety lockout tags, which are elongated tags usually made of laminated cardboard or durable plastic, and which bear a receiving hole through which the hasp of a safety lockout padlock may be inserted (thereby securing the safety lockout tag to the safety lockout padlock). The safety lockout tags also usually bear words and/or images which identify the worker who initiated the lockout, and which warn others that a tagged machine has been locked out for maintenance. In some cases, where the available space about a machine's lockout do not allow the use of a standard safety lockout padlock, elongated calipers are used which close into the receiving apertures of the machine's lockout. The handles of the calipers may then be locked with the safety lockout padlock (and safety lockout tag) to lock out the machine.

In other situations, workers are not assigned their own set of unique safety lockout padlocks and tags, and instead all personnel obtain standard safety lockout padlocks and tags from a lockout station. A lockout station is typically a wall-mounted station where locks and tags are available for employees to access when needed, with several stations being located around the facility at the employer's discretion.

The foregoing lockout procedures, if properly followed, greatly reduce the risk of injury or death to a maintenance worker because the machine is largely restrained from operation (or other release of energy) while the maintenance worker is operating on it. Additionally, other personnel are prevented from starting up the machine during lockout and maintenance.

Unfortunately, the foregoing procedures are often disregarded. Such disregard is typically not intentional, since most workers do not consciously wish to ignore lockout procedures. The disregard for lockout procedures is most often due to a lack of lockout equipment, i.e., of the safety lockout padlocks and tags, which are very easily (and often) forgotten or misplaced. Thus, lockout stations generally tend to have a decreasing inventory of safety lockout padlocks and tags, and at some point there are insufficient numbers available to accommodate workers' needs. This problem, coupled with the problem that lockout stations are not always located at convenient places for workers, can lead workers to cut corners and begin maintenance without following proper lockout procedures. This is particularly true in situations where maintenance workers are under time pressure because each minute of non-operating machinery represents high lost productivity costs to the employer.

Another common problem is that maintenance workers sometimes operate on powered down machinery without lockout because they believe other personnel are absent, and that they may therefore operate on the machines without fear of someone else powering the machines up. This often occurs in nighttime or early morning hours when most personnel are absent and production lines stand idle. Personnel then enter the area and do not see the maintenance worker performing maintenance (particularly since the surroundings may be dimly lit), and they then power up the machinery, often with deadly results.

Because injuries or death resulting from failure to follow lockout procedures can lead to loss of valued personnel, further loss of productivity, and government fines for the employer, many employers impose penalties for workers who do not properly follow lockout procedures (e.g., mandatory attendance at a safety class, a day's dismissal without pay, or the like). This is often effective in promoting proper lockout procedures, but in some cases it can have the opposite effect. For instance, workers who misplace their lockout equipment, fearing that they may be regarded as sloppy and/or that they may face a warning or penalty, may try to work without their lockout equipment with the hope that the lack of proper procedures goes unnoticed, and with the intention to resume their use once the misplaced lockout equipment is found.

It is well known that many industrial injuries and deaths occur each year for failure to follow proper lockout procedures. It would therefore be useful to have additional tools available whereby proper lockout procedures are promoted.

SUMMARY OF THE INVENTION

The invention, which is defined by the claims set forth at the end of this document, is directed to garments (and methods for their use) which at least partially alleviate the aforementioned problems. A basic understanding of some of the preferred features of the invention can be attained from a review of the following brief summary of the invention, with more details being provided elsewhere in this document.

Referring to the drawing to enhance the reader's understanding, a vest 100 is depicted which serves as a portable lockout station for imposing a safety lockout on machinery. The vest 100 includes a pair of opposing chest flaps 102 which join to a vest back 104, with an arm opening 106 situated between each chest flap 102 and the vest back 104, and with a neck opening 108 being situated between the chest flaps 102. The chest flaps 102 descend from the neck opening 108 to a vest waist 110, and are openable and releasably closable by the use of quick-release fasteners (such as by strips 112 of hook-and-loop fasteners, snaps, buckles, or the like) so that a wearer may quickly and easily don and doff the vest 100. Each chest flap 102 includes a breast region 114 adjacent to the neck opening 108. Each breast region 114 is situated over a wearer's breast when the vest 100 is worn. The vest 100 further includes an abdomen region 116 adjacent to the vest waist 110, with each abdomen region 116 being situated over a wearer's abdomen when the vest 100 is worn. The vest 100 is sized so that it is wearable over standard clothing worn by maintenance personnel, e.g., standard denim overalls.

The vest 100 is specially configured so that it may store standard lockout devices for easy access, and so that the wearer is effectively reminded of their presence or absence. Two or more lock pockets 118 are situated on the abdomen regions 116. Preferably, each lock pocket 118 is specially configured to accommodate a single safety lockout padlock 200 by providing the lock pocket 118 with a depth greater than its width (thereby allowing a safety lockout padlock 200, which is generally elongated with a long U-shaped hasp, to snugly fit in each lock pocket 118).

The vest 100 further includes one or more tag pockets 120 which are each situated on one of the breast regions 114, with each tag pocket 120 being specially configured to accommodate one or more safety lockout tags 202. Since safety lockout tags 202 are generally made of laminated paper or cardboard and have a flat, elongated shape, each tag pocket 120 is therefore preferably configured with a depth greater than its width to allow the length of one or more safety lockout tags 202 to snugly slide therein. The material of the tag pocket 120 is preferably formed of a piece of material which is situated coplanarly with the vest 100 and affixed to the vest 100 at its borders so that it is snug (e.g., so that the tag pocket 120 will resist insertion of items having a thickness of over approximately 2 cm), thereby deterring the wearer from placing items other than flat safety lockout tags 202 (such as a safety lockout padlock 200) in the tag pockets 120, owing to their configuration. Thus, by configuring the lock pockets 118 and the tag pockets 120 so that they closely and complementarily accommodate their safety lockout padlocks 200 and safety lockout tags 202 and have difficulty accommodating items having other sizes and configurations, the wearer is effectively encouraged to keep padlocks 200 and tags 202 organized in their respective pockets 118 and 120.

A key pocket 122 is also preferably provided on one of the abdomen regions 116, with the key pocket 122 being sized to accommodate a key-bearing key ring 204 or keychain (with the keys 206 being those that unlock the safety lockout padlocks 200). Since keyrings 204 and keychains may be a variety of different sizes, the size and configuration of the key pocket 122 is not critical, and it may be sized to accommodate items other than keys 206 (e.g., safety glasses, earplugs, gloves, and the like). Flaps 124 are usefully situated adjacent to the lock pockets 118 and the key pocket 122, with the flaps 124 being foldable to open and close the pockets 118, 120, and 122 and bearing quick-release fasteners to maintain the pockets closed (and the safety lockout padlocks 200 and their keys 206 therein) when the user bends or engages in other actions. Closure of the tag pocket 120 is not as critical if the tag pocket 120 is configured to snugly maintain its safety lockout tags 202 therein. For the sake of durability, at least some of the pockets 118, 120, and 122 (and most preferably the lock pockets 118 and the key pocket 122) are formed as pouches (with rear faces 126 which are joined to the vest 100, with the rear faces being joined to opposing front faces 128), so that the safety lockout padlocks 200 and keys 206 do not rest directly on the outer surface of the vest 100 when enclosed in the pockets 118 and 122, with the rear faces 126 of the pockets protecting the vest 100 from wear-through by the safety lockout padlocks 200 and keys 206.

At least a portion of the vest 100 is preferably formed of mesh 130 for light weight and so that the vest 100 will not retain the wearer's heat (though a solid vest 100 could be used where the wearer is to use the vest 100 in cold conditions). The pockets 120, 122, and 124 may be beneficially formed of mesh 130 so that the safety lockout padlocks 200 and their tags 202 and keys 206 are readily visible to the wearer through the mesh 130, though this arrangement is not shown in the accompanying drawing for sake of clarity. Usefully, since safety lockout padlocks 200 are typically brightly colored, situating the lock pockets 118 on the abdomen regions 116 adjacent the vest waist 110, and forming the lock pockets 118 of mesh 130 or other material which is at least partially transparent, will help call a wearer's attention to the lack of a safety lockout padlock 200 when the wearer looks down as the empty pocket 118 and the lack of the brightly colored safety lockout padlock 200 will be readily apparent to the wearer (at least so long as the safety lockout padlocks 200 are differently-colored than the vest 100).

Most preferably, at least a portion of (and preferably all of) the vest 100 is colored in one of the "high-spectrum" colors of orange, yellow, and red (i.e., in a color reflecting light in the yellow-orange range, 550-800 nm), since the human eye is most sensitive to light at the wavelengths of these colors and the vest 100 is therefore more easily seen in low light conditions. Reflective blaze orange is a particularly preferred color for the vest 100, in part because common red, blue, yellow, and green safety lockout padlocks 200 in the lock pockets 118 (or the omission of such padlocks 200) are then readily noticeable to the wearer (when the lock pockets 118 are formed of at least partially transparent materials such as mesh 130).

To further enhance the wearer's visibility to other personnel at the maintenance location, one or more regions of the vest 100 preferably bear reflective stripes (exemplified at 132, 134, and 136) applied thereon. Most preferably, these reflective stripes are defined along the edges of the vest 100, at least along the vest waist 110 and about the borders of the arm openings 106 and neck opening 108 (as with the reflective stripes 132), so that the reflective stripes outline the wearer's shape and allow other personnel in the maintenance location to more easily discern the presence of personnel, as opposed to reflective machinery or other items at the maintenance location.

It is also useful to provide one or more loops 138 on the vest 100 (e.g., straps affixed to the vest 100 at their opposing ends), so that a wearer may affix a radio transmitter/receiver 208, a light 210 such as a flashing safety beacon or flashlight, or other communications, warning, or other devices to a selected loop 138. One or more loops 138 are preferably provided above the breast region 114 and adjacent to the neck opening 108 so that a wearer may easily affix and use a radio transmitter/receiver 208 for communication without having to use his/her hands to detach the radio 208 for use. One or more loops 138 may, if desired, be situated on or adjacent to the key pocket 122 so that a restraining chain (not shown in the drawing) may be strung from the loop 138 to a key ring 204 or key chain stored in the key pocket 122, thereby allowing the wearer of the vest 100 to remove the keys 206 from the key pocket 122 for use, but keeping them restrained so that they cannot be left behind at a maintenance location.

It can further be useful to affix a bright and reflective warning sign 140 on the vest back 104 (or elsewhere on the vest 100) so that it is readily observable by other personnel at the maintenance location. For example, such a sign may read "STOP—LOCK OUT" or the like, to better signal that the machinery under maintenance is not usable. The warning sign 140 bears the added benefit that even when the wearer is not engaged in maintenance, the sign 140 serves as a reminder that lockout procedures should be used when maintenance is required.

In use, maintenance personnel may wear the vest 100 during the course of their duties, with the lock pockets 118 being equipped with safety lockout padlocks 200, the tag pocket 120 being equipped with safety lockout tags 202, and the keys 206 for the safety lockout padlocks 200 being provided in the key pocket 122. Thus, by wearing the vest 100, the wearer is effectively wearing a portable lockout station. The wearer may wear the vest 100 while traveling to machinery to be repaired, and upon reaching the machinery, the safety lockout padlocks 200 (each with a corresponding safety lockout tag 202) may be readily removed from the vest 100 and installed on the machinery. The wearer may then perform maintenance on the machinery, with the wearer being protected both by the lockout imposed on the machinery and also by the highly visible nature of the vest 100.

Once maintenance is completed, the wearer may remove the appropriate keys 206 from the key pocket 122 to unlock the installed safety lockout padlocks 200, which may then be removed and replaced in their lock pockets 118 (and similarly the safety lockout tags 202 may be replaced in the tag pocket 120), with the keys 206 being replaced in the key pocket 122 once the lockout is lifted. Since the vest 100 provides the wearer with convenient storage locations for the safety lockout padlocks 200, the safety lockout tags 202, and the keys 206 once the lockout is lifted, the wearer is far less likely to simply set the padlocks 200 and tags 202 aside when lifting the lockout and testing the repaired machinery, and ultimately forgetting the padlocks 200 and tags 202 at the maintenance location. Rather, the wearer is effectively reminded to place the items in their respective pockets 118, 120, and 122, particularly if the pockets are at least partially transparent (since the wearer will then note the absence of any items when looking downwardly at the vest 100). The wearer may then proceed to subsequent maintenance locations and follow the foregoing procedure at each item of machinery to be repaired, without leaving safety lockout padlocks 200, safety lockout tags 202, and keys 206 scattered amongst the prior maintenance locations. Thus, the wearer does not reach some subsequent maintenance location, only to find that he/she is left with insufficient lockout equipment—a situation which tends to lead to maintenance personnel ignoring proper safety procedures, with potentially deadly results.

Further advantages and features of the invention are discussed and shown in the following detailed description of the invention and in the accompanying drawing.

BRIEF DESCRIPTION OF THE DRAWING

THE FIGURE presents a front perspective view of a portable lockout station vest 100 which exemplifies the invention, with the vest 100 being shown with its chest flaps 102 closed and as it would appear when worn by a maintenance worker (who is not shown). Some lock pockets 118 are shown with their flaps 124 open with safety lockout padlocks 200 inserted within or protruding from the lock pockets 118 (and the adjacent lock pockets 118 are shown with their flaps 124 closed). One tag pocket 120 is shown with its flap 124 open and with a safety lockout tag 202 protruding therefrom, with the other tag pocket 120 being closed. The key pocket 122 is shown with its flap 124 open with a key ring 204 and keys 206 protruding therefrom.

DETAILED DESCRIPTION OF PREFERRED VERSIONS OF THE INVENTION

To describe the preferred vest 100 of THE FIGURE in greater detail, the chest flaps 102 and vest back 104 are formed of fluorescent orange, high strength plastic mesh 130 (the mesh 130 only being shown on the vest back 104 in THE FIGURE for sake of clarity). Such mesh 130 allows the vest 100 to be worn over a worker's standard work clothing without causing discomfort. However, the vest 100 need not be formed of mesh 130, and may (for example) be formed of insulating material to keep the wearer warm, and/or of heat-resistant, puncture-resistant (e.g., Kevlar), flame retardant, waterproof, and/or other materials if the industrial environment warrants. Similarly, depending on the environment in which the vest 100 is to be used, it may also be provided with sleeves, a neck covering, and/or a cowl for protective or other purposes.

To further enhance the wearer's visibility to other personnel, reflective white binding is sewn about the edges of the vest 100 to define reflective edge stripes 132. Adjacent to the vest waist 110, a wide yellow reflective waist stripe 134 encircles the wearer's waist. Chest stripes 136, formed of reflective material similar to that found on road signs and highway equipment, are also defined on the tag pockets 120. The stripes 132 and 134 (and to some extent 136) tend to outline the wearer's torso so that it is apparent even from a distance that a maintenance worker is present, and assure the viewer that he/she is not seeing portions of (or a reflection from) some item of machinery. It should be understood that the presence, number, and placement of the illustrated stripes 132, 134, and 136 are merely exemplary, and that they may be varied. If desired, equipment for further enhancing the visibility of the wearer and the ability of others to detect the wearer's presence may be provided on the vest 100. Apart from matter such as accessory lights 210 being installed on the loops 138, it is also possible to sew warning devices into the vest 100, such as circuitry bearing blinking LEDs, and/or warning beepers.

The preferred dimensions for the vest 100 include a waist diameter (from the edge of one of the chest flaps 102 to the other) being approximately 54 inches. The chest flaps 102 secure to each other by a four inch wide hook-and-loop strip 112 which allows adjustment of the size of the vest 100 across the chest/abdomen area depending on the size of the wearer, thereby effectively providing a one-size-fits-all vest 100. The preferred height of the vest 100 from the vest waist 110 to the top edge of the neck opening 108 is approximately 27 inches. The arm openings 106 preferably have a diameter of approximately 14 inches, and the neck opening preferably measures approximately 12 inches in diameter when the chest flaps 102 are closed. The preferred distance between each arm opening 106 and the neck opening 108 (i.e., the width of the shoulder straps) is approximately 3 inches.

The lock pockets 118 of the vest 100 are formed of a mesh pouch which is separately constructed and then sewn to the abdomen region 116. The pouch is sewn to the abdomen region 116 both at its edges, and also in evenly-spaced vertical rows so as to define seams which effectively define separate lock pockets 118. The lock pockets 118 are preferably approximately six inches deep and slightly less than four inches wide to accommodate standard elongated safety lockout padlocks 200. The lock pockets 118 also preferably bear one inch wide closable flaps 124 which may be secured shut via hook-and-loop material, snaps, or other means of closure.

The tag pockets 120 are also preferably formed as separately constructed mesh pouches which are then sewn to the breast regions 114 of the vest 100. The tag pockets 120 are preferably slightly inclined towards the chin of the wearer (in approximately a 30 degree angle to the vertical) for ease of access, and preferably each measure approximately five inches wide by seven inches deep, with a one inch wide closable flap 124 which may be secured shut by hook-and-loop material, snaps, or other means of closure. As previously noted, the tag pockets 120 are preferably quite snug so that they will only easily accommodate flat material (i.e., safety lockout tags 202), thereby promoting the wearer's orderly organization of lockout equipment (i.e., the wearer is deterred from placing safety lockout padlocks 200 or other matter into the tag pockets 120).

The key pocket 122 is preferably similarly formed as a separately constructed mesh pouch which is then sewn to the abdomen region 116 of the vest 100, and is preferably sized approximately 11.5 inches wides and six inches deep to accommodate a key-bearing key ring 204 (or keychains or other matter).

It should be understood that the various pockets 118, 120 and 122 may be made greater or fewer in number, may be differently sized, and may be differently placed than in the exemplary vest 100 described above and shown in THE FIGURE. Additional pockets intended for bearing tools or the like may also be added to the vest 100.

The loops 138, which are preferably formed of one inch wide by three inch long nylon strips having their ends attached to the vest 100, are depicted in THE FIGURE as bearing a flashing safety light 210 and a communications radio 208. However, it should be apparent that other items such as flashlights, cell phones/pagers, etc. may be mounted on these loops 138 as well. It is preferred that some loops 138 be provided above the breast region 114 of the vest 100 (i.e., about the wearer's shoulders), with these being particularly useful for bearing hands-free communications devices. It can similarly be useful to situate loops 138 on the vest back 104 (such loops 138 not being shown in THE FIGURE) so that battery packs and transmitter/receiver units for communications devices may be mounted on the vest back 104, where they will not interfere with the wearer's motion. It should be understood that the presence, number, and placement of the loops 138 may also be varied.

The warning sign 140 provided on the vest back 104 is optional, and when provided, it is preferably highly reflective and bears text or images which warn other personnel that the wearer may be engaged in lockout activities. Such a warning serves not only to promote the safety of the maintenance worker when performing maintenance, but also as an easily noticeable reminder to personnel that lockout procedures are to be used whenever maintenance is required. Since a brightly-colored vest 100 will draw one's attention, the eyes of personnel will regularly drawn to the wearer, and to the reminder that the warning sign 140 provides.

It is contemplated that the vest 100 will generally be provided to wearers by itself, without providing the accompanying lockout equipment, so that a wearer may choose a preferred brand or style of lockout equipment. However, the vest 100 may also be sold in a lockout kit, with the vest 100 being accompanied by the lockout equipment in ready-to-use form.

The invention is not intended to be limited to the preferred version of the garment described above, but rather is intended to be limited only by the claims set out below. Thus, the invention encompasses all different versions of the garment that fall literally or equivalently within the scope of these claims.

What is claimed is:

1. A portable lockout station garment for imposing a safety lockout on machinery, the garment comprising a vest having:

a. a pair of opposing arm openings with a neck opening therebetween, b. a pair of opposing chest flaps descending from the neck opening to a vest waist, the flaps being releasably closable, wherein each of the chest flaps includes:

(1) a breast region adjacent the neck opening wherein the breast region situates over a wearer's breast, and (2) an abdomen region adjacent the vest waist wherein the abdomen region situates over a wearer's abdomen, c. two or more lock pockets on the abdomen regions, each lock pocket having a depth greater than its width to accommodate a safety lockout padlock, with two or more safety lockout padlocks, each being situated in one of the lock pockets;

d. a key pocket on one of the abdomen regions, the key pocket being sized to accommodate one or more keys, with one or more keys in the key pocket, each key being configured to allow unlocking of one or more of the safety lockout padlocks;

e. a tag pocket on one of the breast regions, each tag pocket having a depth greater than its width to accommodate a safety lockout tag, with one or more safety lockout tags in the tag pocket, wherein at least a major portion of the vest is colored in the yellow-orange range.

2. The portable lockout station garment of claim 1 wherein at least a major portion of the vest is formed of mesh.

3. The portable lockout station garment of claim 1 wherein one or more regions of the vest bear reflective stripes applied thereon.

4. The portable lockout station garment of claim 3 wherein at least some of the reflective stripes are defined along the edges of the vest.

5. The portable lockout station garment of claim 1 further comprising one or more loops, each loop being situated above the abdomen region.

6. The portable lockout station garment of claim 5 wherein one or more of the loops are situated above the breast region.

7. The portable lockout station garment of claim 5 in combination with at least one of:

a. a radio, and b. a light, removably mounted on the loop.

8. The portable lockout station garment of claim 1 wherein the vest includes a vest back descending from the neck opening opposite the chest flaps, and wherein the vest back includes a warning sign thereon.

9. The portable lockout station garment of claim 1 further comprising flaps situated adjacent the lock pockets and key pocket, the flaps being foldable to open and close the pockets.

10. The portable lockout station garment of claim 1 wherein the tag pocket is formed of a piece of material situated coplanarly with the vest and affixed to the vest at its borders, whereby the tag pocket resists insertion of items having a thickness of over 2 cm when the vest is worn.

11. The portable lockout station garment of claim 1 wherein at least some of the pockets are formed as pouches with rear faces which are joined to the vest, with the rear faces being joined to opposing front faces.

12. The portable lockout station garment of claim 1 wherein:

a. at least a portion of the vest is formed of mesh; and b. one or more regions of the vest bear reflective stripes applied thereon; and c. one or more regions of the vest bear one or more loops thereon.

13. A portable lockout station garment for imposing a safety lockout on machinery, the garment comprising:

a. a vest having:

(1) a pair of opposing arm openings with a neck opening therebetween, (2) a pair of opposing chest flaps descending from the neck opening to a vest waist, the flaps being openable and closable to allow a wearer to don and doff the vest, (3) two or more lock pockets, each lock pocket being situated on one of the chest flaps and being sized to accommodate a safety lockout padlock, with each lock pocket having a depth greater than its width;

(4) a key pocket on one of the chest flaps, the key pocket being sized to accommodate one or more keys;

(5) a tag pocket on one of the chest flaps, the tag pocket being sized to accommodate a safety lockout tag, with each tag pocket having a depth greater than its width, and being formed of a piece of material situated coplanary with the vest and affixed to the vest at its borders, whereby the tag pocket resists insertion of safety lockout padlocks when the vest is worn;

b. safety lockout padlocks provided in the lock pockets;

c. one or more keys in the key pocket, each key being configured to allow unlocking of one or more of the safety lockout padlocks;

d. one or more safety lockout tags in the tag pocket, whereby a wearer may wear the vest while traveling to machinery to be repaired, remove and install one or more safety lockout padlocks and safety lockout tags on the machinery, and after maintenance is performed on the machinery, remove the keys and unlock the installed safety lockout padlocks from the machinery to allow replacement of the safety lockout padlocks, safety lockout tags, and keys in the vest.

14. The portable lockout station garment of claim 13 wherein:

a. at least a portion of the vest is formed of mesh, and b. at least a major portion of the vest is colored in the yellow-orange range.

15. The portable lockout station garment of claim 13 further comprising one or more loops situated above the breast region and adjacent the neck opening.

16. The portable lockout station garment of claim 13 wherein reflective stripes are situated along the vest waist and about the borders of the arm openings.

17. The portable lockout station garment of claim 13 wherein at least the lock pockets and the key pocket are formed as pouches with rear faces which are joined to the vest, with the rear faces being joined to opposing front faces.

18. The portable lockout station garment of claim 13 wherein the vest includes a vest back descending from the neck opening opposite the chest flaps, and wherein the vest back includes a warning sign thereon.

19. The portable lockout station garment of claim 13 further comprising flaps situated adjacent the lock pockets and key pocket, the flaps being foldable to open and close the pockets.

20. A method of imposing a safety lockout on machinery comprising:

a. providing a portable lockout station garment having:

(1) a vest which includes:

(a) a pair of opposing arm openings with a neck opening therebetween, (b) a pair of opposing chest flaps descending from the neck opening to a vest waist, the flaps being openable and closable to allow a wearer to don and doff the vest, (c) two or more lock pockets, each lock pocket being situated on one of the chest flaps and being sized to accommodate a safety lockout padlock;

(d) a key pocket on one of the chest flaps, the key pocket being sized to accommodate one or more keys;

(e) a tag pocket on one of the chest flaps, the tag pocket being sized to accommodate a safety lockout tag b. providing safety lockout padlocks in the lock pockets;

c. providing one or more keys in the key pocket, each key being configured to allow unlocking of one or more of the safety lockout padlocks;

d. providing one or more safety lockout tags in the tag pocket, e. wearing the vest while traveling to machinery to be repaired;

f. at the machinery to be repaired, removing one or more of the safety lockout padlocks and one or more of the safety lockout tags from the vest;

g. installing each of the removed safety lockout padlocks with one of the removed safety lockout tags on the machinery;

h. performing maintenance on the machinery;

i. removing one or more of the keys from the vest, each removed key being one which unlocks at least one of the installed safety lockout padlocks;

j. unlocking each of the installed safety lockout padlocks;

k. replacing:

(1) the removed safety lockout padlocks in the lock pockets, (2) the removed safety lockout tags in the tag pocket, and (3) the keys in the key pocket.

21. The method of claim 20 further comprising the steps of:

a. traveling to a subsequent location where maintenance is required, and b. repeating steps 20.f-20.k of claim 20.

* * * * *